US006684673B2

(12) United States Patent
Florendo

(10) Patent No.: US 6,684,673 B2
(45) Date of Patent: Feb. 3, 2004

(54) KEYPOUCH

(76) Inventor: Rufino Florendo, 19-38 Fairview Rd. West, Mississauga (CA), L5B 4J8

( * ) Notice: Subject to any disclaimer, the term of this patent is extended or adjusted under 35 U.S.C. 154(b) by 0 days.

(21) Appl. No.: 10/077,710

(22) Filed: Feb. 14, 2002

(65) Prior Publication Data

US 2003/0164013 A1 Sep. 4, 2003

Related U.S. Application Data

(60) Provisional application No. 60/274,645, filed on Mar. 13, 2001.

(51) Int. Cl.[7] ..... A45C 11/32
(52) U.S. Cl. ..... 70/456 R; 70/456 B; 150/131
(58) Field of Search ..... 70/456 R; 150/131–153

(56) References Cited

U.S. PATENT DOCUMENTS 1,138,768 A * 5/1915 McFarland ..... 70/456 R
1,538,593 A * 5/1925 Rolfs ..... 70/456 R
1,574,832 A * 3/1926 McDill ..... 70/456 R
1,581,016 A * 4/1926 Reiter ..... 70/456 R
1,613,760 A * 1/1927 Lorber ..... 70/456 R
2,038,070 A * 4/1936 Welch ..... 70/456 R
2,066,526 A * 1/1937 Gladstone ..... 70/456 R
2,201,850 A * 5/1940 Dawson, Jr. ..... 70/456 R
3,999,317 A * 12/1976 Owens ..... 150/147
4,306,433 A * 12/1981 Kelly ..... 70/456 R
4,796,750 A * 1/1989 Inghram ..... 70/456 R
5,588,571 A * 12/1996 Mazzo ..... 150/136
5,778,954 A * 7/1998 Sullivan et al. ..... 150/147

* cited by examiner

*Primary Examiner*—Anthony Knight
*Assistant Examiner*—Christopher J. Boswell
(74) *Attorney, Agent, or Firm*—Elias C. Borges

(57) ABSTRACT

This invention entitled "KEYPOUCH", is a double sided key chain holder made of leather with two side pockets provided by means of flaps and also having three rings (two small and one big) secured at the top by means of a strap. One small ring holds the remote control unit transmitter on one side pocket. On the other side pocket, the car key is attached to the other small ring and the rest of the keys, such as house keys, car door keys, garage keys, mail box keys and the like are attached to the big ring.

6 Claims, 2 Drawing Sheets

D

A
C

KEYPOUCH

CROSS REFERENCE TO RELATED APPLICATIONS

This application claims priority from provisional application Ser. No. 60/274,645 entitled "KEYPOUCH" filed on the Mar. 13, 2001, which is incorporated herein by reference.

FIELD OF THE INVENTION

This invention relates to a key chains and key holders.

BACKGROUND OF THE INVENTION

Usually, key chains have one ring to hold all the keys including remote control unit transmitter. Since all of the keys and the remote control unit transmitter are attached to a single large key ring, it can be difficult to organize the keys for ease of use. Furthermore, in one ring key chains, the remote control unit transmitter is not protected and the keys are not together thus making a hole in the pant's pocket most of the time.

SUMMARY OF THE INVENTION

The present invention overcomes the drawbacks of the prior art by providing a key pouch which makes organizing keys easier. To keep all the keys together on one side and the remote control unit transmitter on the other side, the keypouch of the present invention is provided with two pockets. One side pocket is adapted and configured to hold the remote control unit transmitter and the other side pocket is adapted and configured to hold the keys.

The two side pockets are formed by flaps. The pouch is provided with three attachment rings. The three rings are secured to the pouch by a strap. Preferably, one of the three rings is larger than the other two. One of the smaller rings is adapted to hold the remote control unit transmitter on one side pocket. On the other side pocket, the other small ring will hold the car key and the big ring will hold the rest of the keys. The present invention protects the remote control unit, permits easier organization of all the keys also ensure that holes in the user's pants pocket are avoided.

DETAILED DESCRIPTION OF THE INVENTION

Figure 1:
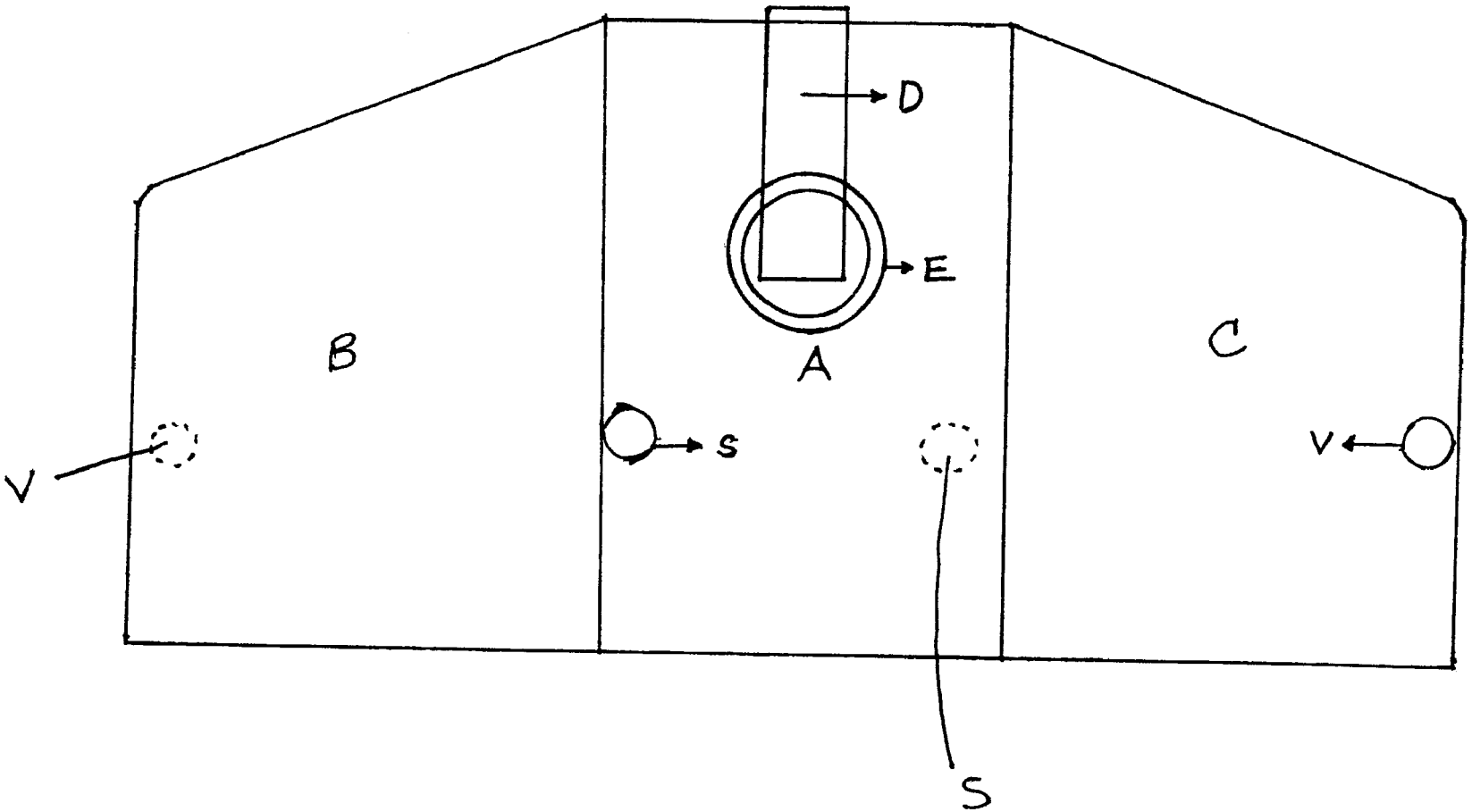
FIG. 1. is a side view of the invention showing the flaps fully open.

The "KEYPOUCH" illustrated in FIG. 1 consists of a central body A and opposite side flaps B and C. Flaps B and C can be folded onto either side of body A to form two opposite side pockets located on opposite sides of central body A. Flap C can be held in a folded position over body A by means of snap or velcro fasteners S and V. Likewise, flap B can be folded over and secured on the other side of body A by means of snap or velcro fasteners S and V.

The strap D, secured at the top of the body, hold three key rings E. Preferably, one of the key rings is larger than the other two. One of the small key rings is intended to hold the remote control unit transmitter which can be stored in one of the side pockets formed by flaps B or C. In the other side pocket formed on the opposite side of body A, the other small ring can hold the car key and the larger ring may hold additional keys such as house keys, garage door keys, mailbox keys or the like.

Figure 2:
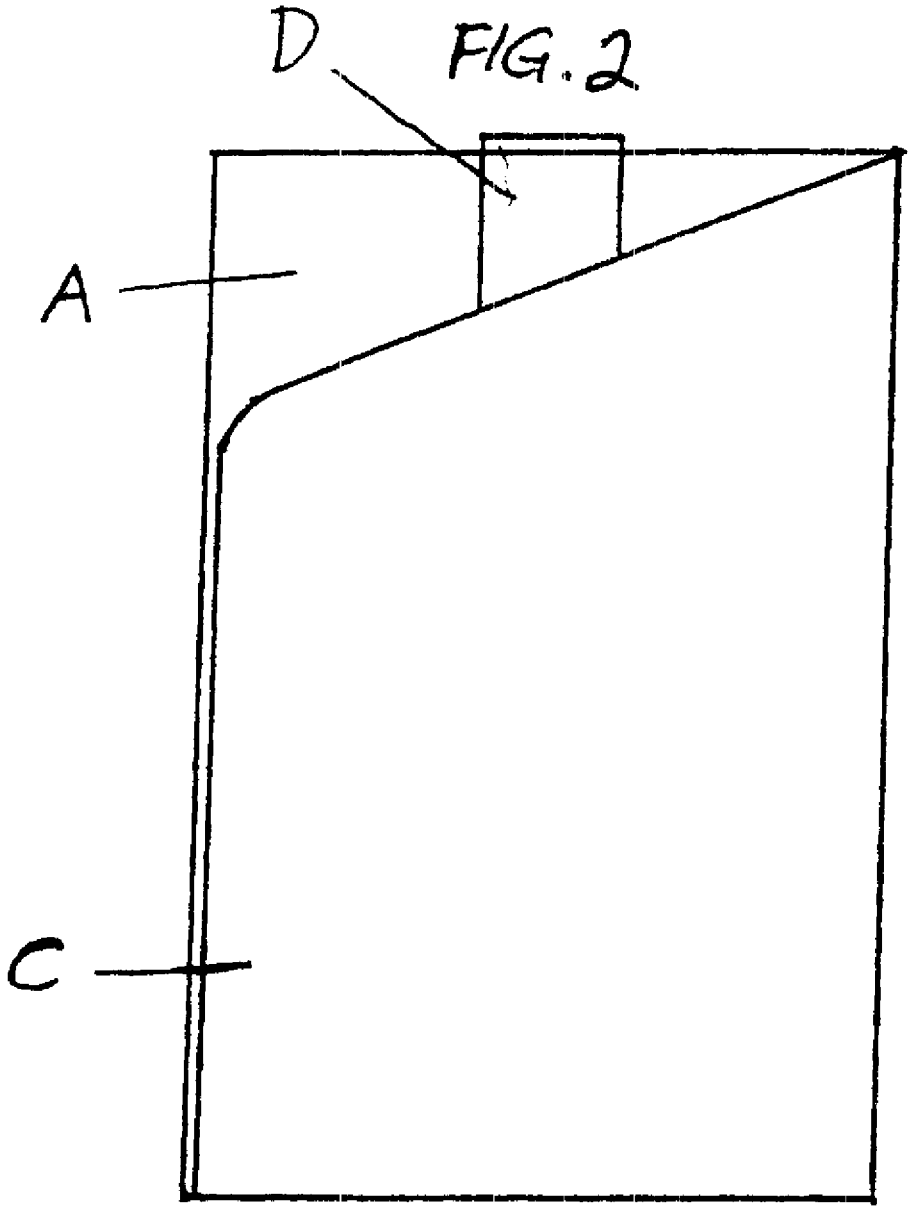
FIG. 2. is a side view of the invention with the flaps fully closed.

With the flaps folded over body A, the keys can be safely held in the pocket formed between the flap and the central body, as illustrated in FIG. 2. The keys, and the remote transmitter, are thereby protected by the overlapping flap.

I claim:

1. A key holder comprising:

a central body;

two flaps attached to the body, each flap foldable and releasably securable upon the body and each forming a pocket when secured to said body;

a strap secured to a front side of the body, extending over to and secured to a back side of the body;

three key holding rings secured upon the strap, each said ring being capable of holding more then one key, and each said ring being movable into either said pocket for storage of each said ring.

2. A key holder as recited in claim 1 wherein one said flap is foldable on the front side of the body creating a front pocket and the other flap is foldable on the back side of the body creating a back pocket.

3. A key holder as recited in claim 2 wherein each said flap is releasably secured to the body by a hook and loop fastener which attaches a portion of each flap to said body.

4. A key holder as recited in claim 1 or 2 wherein each said flap is releasably secured to said body by means of a snap fastener.

5. A key holder as recited in claim 2 wherein a first key holding ring, holds one key and is placed in and removable from said rear pocket, a second key holding ring holds a remote control transmitter and is placed in and removable from said front pocket, and a third key holding ring holds a plurality of keys and is placed in and removable from said front pocket.

6. A key holding ring as recited in claim 5 wherein said third key holding ring is larger than said first and second key holding rings.

* * * * *